United States Patent [19]

Wiese et al.

[11] Patent Number: 5,032,155

[45] Date of Patent: Jul. 16, 1991

[54] WET/DRY VACUUM WITH AUTOMATIC SHUTOFF

[75] Inventors: Martin E. Wiese, South Bend, Ind.; Charles C. Wray, Jr., Denver, Colo.

[73] Assignee: White Consolidated Industries, Inc., Cleveland, Ohio

[21] Appl. No.: 585,727

[22] Filed: Sep. 20, 1990

[51] Int. Cl.[5] ..... B01D 39/00

[52] U.S. Cl. ..... 55/216; 15/353; 55/DIG. 3

[58] Field of Search ..... 55/169, 216, 219, 429, 55/432, DIG. 3; 15/353

[56] References Cited

U.S. PATENT DOCUMENTS

| | | | |
|---|---|---|---|
| 2,719,596 | 10/1955 | Kerm et al. | 55/216 |
| 3,930,281 | 1/1976 | Principe | 15/320 |
| 4,055,405 | 10/1977 | Thun-Hohenstein | 55/216 |
| 4,179,768 | 12/1979 | Sawyer | 55/216 X |
| 4,218,805 | 8/1980 | Brazier | 15/321 |
| 4,275,731 | 6/1981 | Nichols | 28/276 |
| 4,315,342 | 2/1982 | Neroda | 15/339 |
| 4,549,329 | 10/1985 | St. Clair | 15/353 |
| 4,776,060 | 10/1988 | Chang | 15/339 |

*Primary Examiner*—Charles Hart

*Attorney, Agent, or Firm*—Pearne, Gordon, McCoy & Granger

[57] ABSTRACT

A wet/dry vacuum cleaner including a tank for the collection of liquid, an inlet socket for connection to a suction head, a cover for closing the top of the tank, and a centrifugal vacuum blower mounted on the cover with an axial air inlet opening to the interior of the tank. A solid matter filter is located in the tank and covers the axial air inlet to the blower. The unit includes a float valve assembly that utilizes an annular seal gasket secured to the bottom of the cover and a bowl-shaped float suspended in the tank below the gasket and having an upwardly facing annular rim adapted to sealingly engage the gasket. The float is shaped to define a downwardly extending recess adapted to surround the filter element so that when the liquid level in the tank reaches a predetermined level, the float is buoyed upwardly until its annular rim engages the seal gasket to interrupt the flow of air to the blower inlet.

5 Claims, 3 Drawing Sheets

WET/DRY VACUUM WITH AUTOMATIC SHUTOFF

BACKGROUND OF THE INVENTION

This invention relates to portable vacuum cleaners, and especially to the type generally referred to as "wet/dry" vacuum cleaners, which are capable of picking up not only solid matter, such as dust, dirt and other dry debris, but also liquid or semiliquid material. More particularly, the invention relates to a unique means for interrupting the suction when the liquid level in a collector tank reaches a predetermined level. This prevents the liquid from being drawn into the vacuum blower intake and from contacting the filter normally interposed between the vacuum blower air inlet and the collection tank.

Wet/dry-type vacuum cleaners are used for a variety of purposes, such as the extraction of liquid used in the cleaning of floors, carpets, upholstery, etc. In these vacuum units, the liquid is sucked into a tank through a vacuum hose, and thus it accumulates progressively in the collection tank during the operation. In order to prevent the liquid from rising above a predetermined level limit where it could overflow, block a blower inlet, damage a dust filter, etc., it is advantageous to provide a device that interrupts the air flow producing the suction, and thus prevents further liquid accumulation.

In prior art devices, this requirement has been met in several ways, such as by using a float-operated control mechanism that opens a switch to turn off the vacuum blower motor. Another means involves the use of a sphere-shaped rising float that will, upon reaching a certain height, engage an air flow port or inlet to block further flow of air to the blower.

There techniques and others, however, have certain deficiencies and disadvantages. A float-operated switch is often unreliable, particularly since a failure of the float, the float linkage, or the switch itself will result in an overflow. A float, such a sphere or ball-shaped device that rises to sealing engagement with an air inlet is often not shaped properly, and may not achieve a complete seal. Also, the float may become punctured and fill with liquid.

The device of the present invention, however, resolves many of the difficulties indicated above and affords other features and advantages heretofore not obtainable.

SUMMARY OF THE INVENTION

It is among the objects of the present invention to provide an improved means for interrupting the flow of air to a vacuum blower motor in a wet/dry vacuum system when the water collected in the collection tank reaches a predetermined level.

Another object of the invention is to protect a dust filter used in a wet/dry-type vacuum cleaner device against contact with liquid that accumulates in a collection tank associated with the device.

These and other objects and advantages are achieved with the unique wet/dry vacuum operating system of the invention. The vacuum cleaner assembly includes, as its more conventional components, a tank for the collection of liquid, an inlet socket for connection to a suction head for picking up liquid, a cover for closing the top of the tank, and a vacuum blower motor mounted on the cover and having a centrifugal blower with a central air inlet communicating with the interior of the tank. A solid matter filter located in the tank is mounted over the air inlet in a conventional manner to prevent harmful dust, dirt, etc. from being sucked into the blower.

In accordance with the invention, there is provided a float valve assembly for interrupting the flow of air to the central air inlet through the filter. The assembly includes a seal gasket secured to the bottom of the cover and having a downwardly facing sealing surface. A bowl-shaped float is located in the tank below the gasket and has an upwardly facing perimetric rim adapted to sealingly engage the sealing surface of the gasket. The float is shaped to define a downwardly extending recess adapted to surround the filter element throughout its range of vertical movement. The float is supported by means associated with the tank and adapted to engage the rim of the flat so that it may be suspended in a normal position, with the bottom thereof spaced from the bottom of the collection tank. When so supported, the float, and particularly the rim thereof, defines with the gasket a peripheral opening permitting air to flow therethrough into the recess, and thus to the filter.

The float is vertically movable between its first position described above and a second position wherein the float is buoyed upward in response to the liquid level, into sealing engagement with the gasket to close the peripheral air passage in response to a predetermined liquid level in the tank. In its second sealing position, the float prevents air from being sucked through the filter into the blower inlet, and thus positively prevents any further accumulation of liquid in the tank.

The blower motor selected is designed to be a bypass-type device so that an air flow to provide motor cooling continues whether the flow through the centrifugal blower continues or not.

DESCRIPTION OF THE PREFERRED EMBODIMENTS

Figure 1:
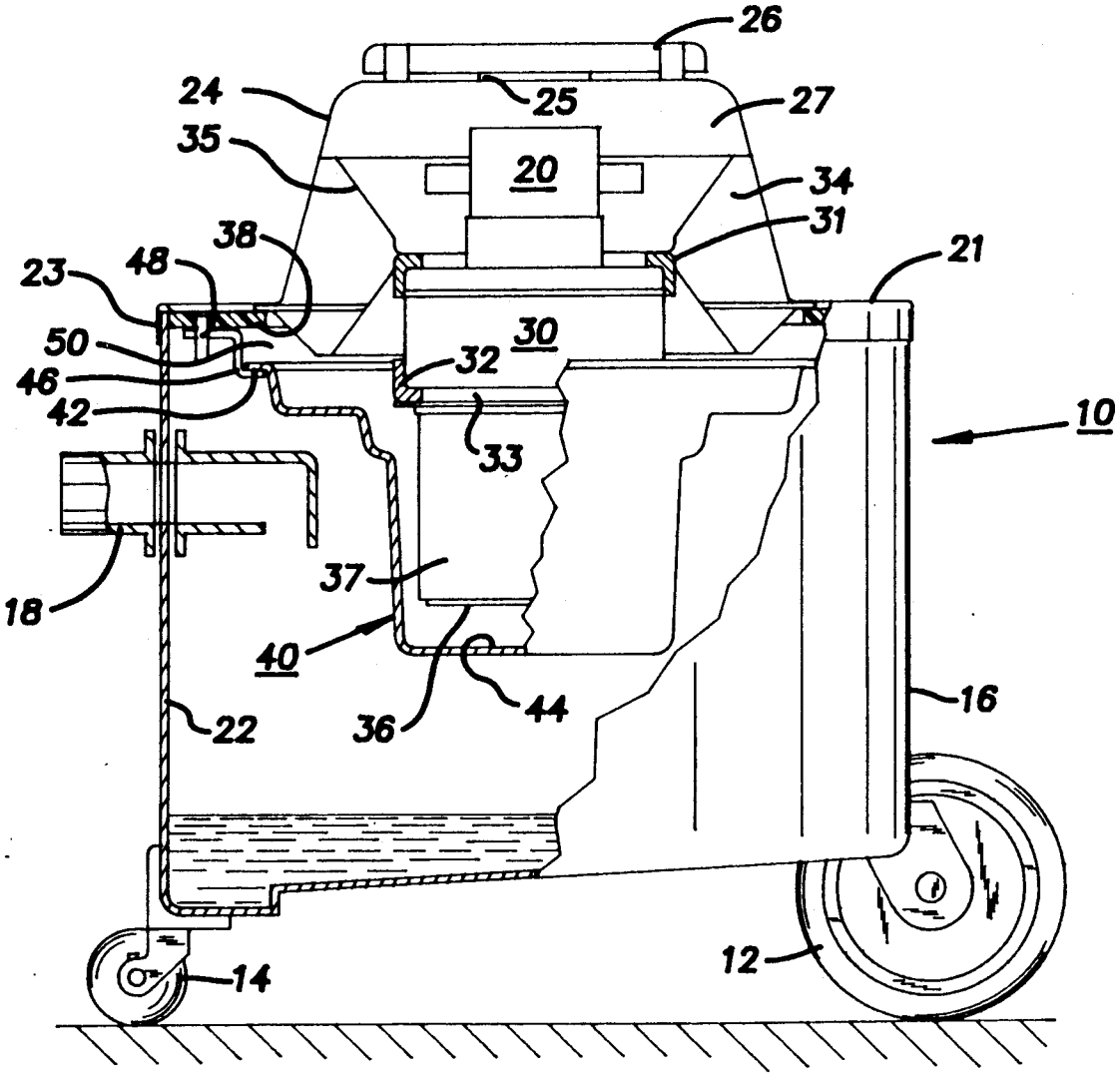
FIG. 1 is an elevational view of a wet/dry vacuum cleaner unit embodying the invention, with parts broken away and shown in section for the purpose of illustration.

Referring more particularly to the drawings, and initially to FIG. 1, there is shown a wet/dry vacuum cleaner, referred to generally by the numeral 10. The unit includes a plurality of wheels 12 and at least one caster 14 for rolling transportation of the device so that it may easily be moved to a desired location. The unit has as conventional components a liquid collection tank 16 carried by the wheels and casters, and provided with an air and liquid inlet socket 18. The socket is intended to permit connection thereto of a vacuum hose with a suction head (not shown) used to draw dirt, debris, and liquid into the collection tank.

An electric blower motor 20 is mounted on an annular tank cover 21 adapted to fit over the rim of the tank. In the device shown, the tank is round and has a cylindrical side wall 22 with upper edges lying in a plane and adapted to receive the cover 21. The cover has a downwardly extending flange 23 which fits over the upper edges of the side wall of the tank 16. An inverted dish-shaped motor cover 24 is positioned over the top of the motor and secured to the tank cover 21.

The motor cover 24 has a central opening 25 at the top thereof, and a vent cover 26 is mounted thereover but spaced from the top of the cover 24. Thus, the motor cover 24 defines a cooling chamber 27. This permits the flow of air into the interior of the cover 24 to provide a cooling flow for the motor 20.

The motor 20 drives a centrifugal vacuum blower 30 which is supported by the tank cover 21, and which has a downwardly facing, axial air inlet 33. The centrifugal blower 30 is supported by means of annular gaskets 31 and 32 to cushion vibration, and thus reduce noise during operation. The blower 30 has an outlet for exhausting air in a tangential manner into an annular chamber 34 located above the top cover 21 and separated from the cooling chamber 27 by a frustoconical partition 35.

The blower 30 draws air through a high energy filter 36 having a generally cylindrical shape and contained in a cylindrical filter housing 37 attached to the bottom of the tank cover 21. Accordingly, any air drawn into the centrifugal blower through the inlet 33 must first pass through the filter 36 so that any dust, dirt, or other solid debris will be filtered out.

In accordance with the present invention, there is provided a unique means for cutting off the flow of air to the vacuum blower whenever the level of liquid in the tank 16 rises above a certain predetermined level.

In this regard, an annular sealing gasket 39 is secured to the bottom face of the tank cover 21 at the outer circumferential portion thereof. The sealing gasket 38 has a downwardly facing sealing surface that faces toward the bottom of the tank.

Cooperating with the sealing gasket 38 is a bowl-shaped float 40 that is supported in a position raised from the bottom of the collection tank 16 and having a normal position (FIG. 1) closely spaced from the top cover. The float has a peripheral, horizontal, radial flange 42 and a central portion 43 that defines a relatively large recess 44 adapted to be spaced from and accommodate the high energy filter 36 and its cylindrical filter housing 37.

The float 40 is supported by three or more brackets 46 that are mounted near the periphery of the tank cover 21 and below the sealing gasket 38. The brackets 46 are mounted to the top cover by screws 48 or other fasteners. The brackets have a Z-shaped configuration and the inner portion is adapted to engage and support thereon the rim or flange 42.

Thus, the bottom face of the sealing gasket 38 and the top face of the perimetric flange 42 define a peripheral air flow passage 50 so that air from the tank may flow in a radial direction therethrough and into the recess 44 formed by the float 40. The air in the recess flows (in the direction indicated by the arrows) somewhat downwardly through the recess, then upwardly around the walls of the filter housing 37, and through the high energy filter 36 to the filter 33 for the centrifugal vacuum blower.

Figure 2:
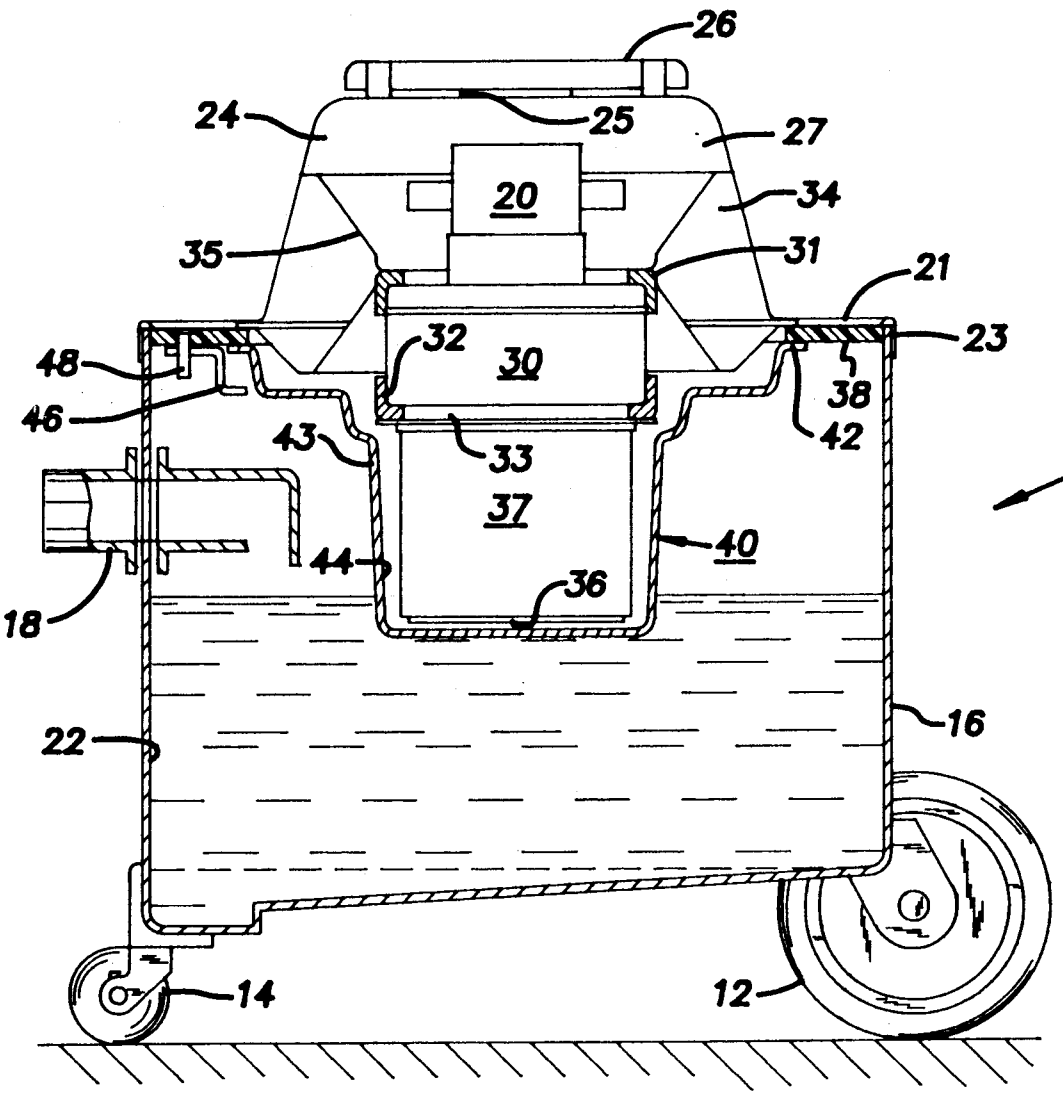
FIG. 2 is a sectional view of the wet/dry vacuum cleaner unit of FIG. 1, showing the float buoyed upwardly by liquid in the collection tank into a sealing position so as to cuf off the suction caused by the vacuum blower.
Figure 3:
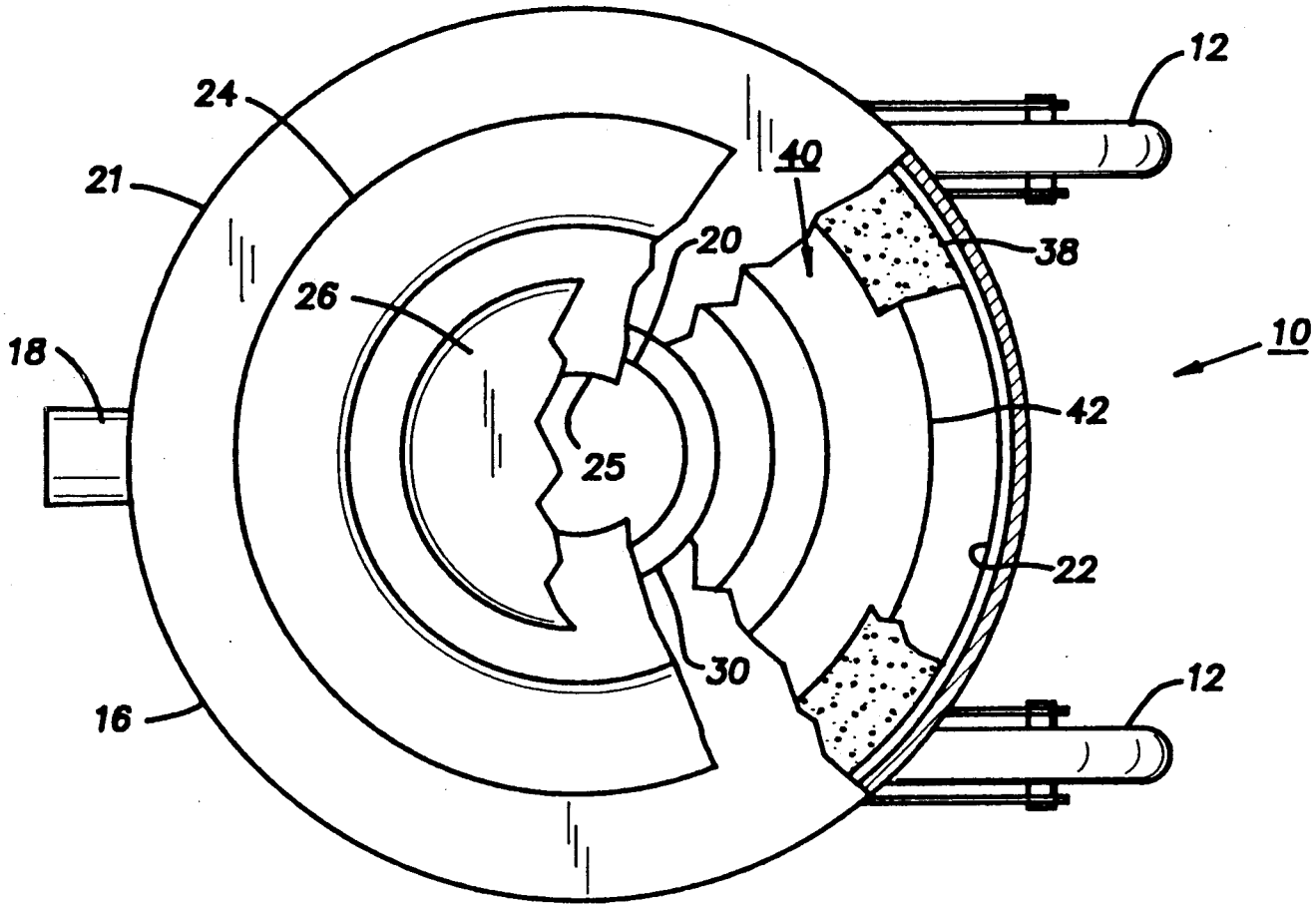
FIG. 3 is a plan view of the wet/dry vacuum cleaner unit of FIGS. 1 and 2, with parts broken away and shown in section for the purpose of illustration.

It will be seen that the float 40 will remain in the position illustrated in FIG. 1 as long as an excessive volume of liquid does not accumulate in the collection tank 16. However, in the event that the liquid level in the tank does rise to an undesirable level, the liquid will buoy up the float until the perimetric rim 42 engages the bottom of the sealing gasket 38 (FIG. 2). When that occurs, the air flow through the peripheral passage 50 will be interrupted and no more air will be drawn into the axial inlet 33 for the vacuum blower. As a consequence, no more suction will be produced, and thus no more liquid can accumulate in the tank.

Thus, the float 40 prevents tank overflow and also prevents liquid from contacting the high energy filter 36.

The interruption of air flow to the axial inlet for the centrigual blower will merely result in the blower's spinning without any vacuum-producing effect. The blower motor will continue to be cooled by the flow of air through the cooling chamber 27 as before.

In operation, the person using the vacuum unit will be alerted to the full tank condition by the absence of suction, and may then empty the tank and return the unit to its intended function.

While the invention has been shown and described with respect to a particular embodiment thereof, this is for the purpose of illustration rather than limitation, and other variations and modifications of the specific embodiment herein shown and described will be apparent to those skilled in the art all within the intended spirit and scope of the invention. Accordingly, the patent is not be be limited in scope and effect to the specific embodiment herein shown and described nor in any other way that is inconsistent with the extent to which the progress in the art has been advanced by the invention.

What is claimed is:

1. In a wet/dry vacuum cleaner including a liquid collection tank, an inlet to said tank for connection to a suction head, a cover for closing the top of the tank, a motor and vacuum blower mounted on the cover and having a central air inlet communcating with the tank and a solid matter filter located in the tank over the air inlet to the vacuum blower, the improvement which comprises:

a seal gasket secured to the bottom of the tank cover and having a downwardly facing sealing surface;

a bowl-shaped float located in said tank below said gasket and having an upwardly facing perimetric rim adapted when in a raised, closed position to sealingly engage said gasket, said float being shaped to define a recess adapted to surround said filter thereabove and be spaced thereform; and means for supporting said float in an open position above the bottom of said tank with said rim spaced below said gasket to define therewith a peripheral passage permitting air to flow radially inwardly therethrough to said filter, said float being vertically movable from said open position to said closed sealing position in response to the liquid level in said tank to close said peripheral air passage and prevent further suction.

2. A wet/dry vacuum cleaner as defined in claim 1, wherein said seal gasket and said perimeter rim of said float are annular and concentric with the central axis of said collection tank.

3. A wet/dry vacuum cleaner as defined in claim 2, wherein said vacuum blower is a centrifugal blower with an axial inlet and wherein said axial inlet is concentric with said seal gasket and said float.

4. A wet/dry vacuum cleaner as defined in claim 3, wherein said solid matter filter is cylindrical and concentric with said axial inlet for said centrifugal blower.

5. A wet/dry vacuum cleaner as defined in claim 2, wherein said float is supported in its open position by at least three symmetrically spaced brackets secured to the bottom of said cover and adapted to engage the annular bottom face of said float rim.

* * * * *